US008631873B2

(12) United States Patent
Sneed

(10) Patent No.: US 8,631,873 B2
(45) Date of Patent: Jan. 21, 2014

(54) TUBING HANGER—PRODUCTION TUBING SUSPENSION ARRANGEMENT

(75) Inventor: Brian A. Sneed, Magnolia, TX (US)

(73) Assignee: Proserv Operations, Inc., Houston, TX (US)

( * ) Notice: Subject to any disclaimer, the term of this patent is extended or adjusted under 35 U.S.C. 154(b) by 274 days.

(21) Appl. No.: 13/041,175

(22) Filed: Mar. 4, 2011

(65) Prior Publication Data

US 2012/0222866 A1 Sep. 6, 2012

(51) Int. Cl.
*E21B 17/00* (2006.01)
*E21B 33/035* (2006.01)

(52) U.S. Cl.
USPC ..... 166/348; 166/344; 166/360; 166/368; 166/75.14; 138/177; 285/123.1; 285/923

(58) Field of Classification Search
USPC ..... 166/348, 344, 351, 360, 368, 378–380, 166/75.14; 138/155, 177; 285/123.1, 329, 285/390, 422, 238, 55, 923
See application file for complete search history.

(56) References Cited

U.S. PATENT DOCUMENTS 1,827,287 A * 10/1931 Guidinger ..... 285/123.1
3,095,042 A 6/1963 Clark, Jr. et al.
3,177,013 A 4/1965 Rector
4,057,108 A * 11/1977 Broussard ..... 166/371
4,511,002 A 4/1985 Adamek et al.
5,341,885 A * 8/1994 Bridges ..... 166/382
5,456,321 A 10/1995 Shiach et al.
5,927,403 A * 7/1999 Dallas ..... 166/77.51
5,984,008 A * 11/1999 Lang et al. ..... 166/208
6,019,175 A * 2/2000 Haynes ..... 166/382
6,220,363 B1 * 4/2001 Dallas ..... 166/382
6,651,737 B2 * 11/2003 Bouligny et al. ..... 166/52
7,419,001 B2 * 9/2008 Broussard ..... 166/77.51
7,604,047 B2 * 10/2009 Broussard ..... 166/75.14
7,607,485 B2 * 10/2009 Fenton et al. ..... 166/368
7,789,133 B2 * 9/2010 McGuire ..... 166/90.1
8,016,031 B2 * 9/2011 McGuire ..... 166/90.1
2004/0129429 A1 7/2004 Dallas
2007/0261768 A1 11/2007 Reynolds, Jr.
2008/0087415 A1 4/2008 McGuire et al.
2008/0277933 A1 11/2008 Church
2009/0078404 A1 * 3/2009 Schepp ..... 166/75.14
2009/0114397 A1 * 5/2009 McGuire et al. ..... 166/379
2011/0247828 A1 * 10/2011 Patel et al. ..... 166/348

OTHER PUBLICATIONS

International Search Report of corresponding counterpart international application No. PCT/US2012/026994 and dated Jun. 6, 2012.

* cited by examiner

*Primary Examiner* — Matthew Buck
(74) *Attorney, Agent, or Firm* — Gary L. Bush; Andrews Kurth LLP

(57) ABSTRACT

A tubing hanger body made from Non-CRA steel coupled to production tubing made from CRA material. The coupling includes pin threads at the top end of the production tubing which are arranged to be screwed into box threads of the tubing hanger body. A seal sub having metal-to-metal and/or elastomeric seals engages the top end of the production tubing and protects the tubing hanger body from contact with production fluid flowing from the production tubing below to a Christmas tree tubing above. The invention includes a method of repairing of an existing tubing hanger body where its through bore has been damaged. This allows the through bore to be over machined and a CRA sleeve installed to replace tubing threads and body material.

3 Claims, 4 Drawing Sheets

TUBING HANGER—PRODUCTION TUBING SUSPENSION ARRANGEMENT

BACKGROUND OF THE INVENTION

1. Field of the Invention

This invention relates generally to a wellhead assembly for an oil and gas well. The invention may find use in a tubing hanger arrangement used in completion of an offshore oil and gas well and in completion of land oil and gas wells.

2. Description of the Prior Art

U.S. Pat. No. 7,604,047 which issued on Oct. 20, 2009 and U.S. Pat. No. 7,419,001 illustrate and describe a universal tubing hanger suspension assembly for an offshore well that includes a tubing hanger housing that is positioned in the wellhead housing independently of knowledge of details of a wellhead housing in which the tubing hanger is to be placed. As shown in FIG. 1, the prior tubing hanger suspension assembly 10 includes a tubing hanger housing 12 and a tubing hanger lower assembly 14. After the tubing housing 12 is installed in the wellhead 8 a Christmas tree connector 4 is run and connects to the housing 12, for mounting a Christmas tree on the wellhead 8.

Production tubing 22 is coupled to the bottom of the tubing hanger 12 by a threaded connection 20, with pin threads 5 cut in the tubing hanger housing 12 body coupled with box threads 6 of the production tubing 22. The tubing hanger housing 12 is supported in place by locking and sealing mechanism 34 between tubing hanger lower assembly 14 and production casing 18 below wellhead 8. The production casing hanger 18*a* is supported on the casing hanger 25. Both the tubing hanger housing 12 and the production tubing 22 must be made of Corrosion Resistant Alloy (CRA) material, because highly corrosive contaminants such as $H_2S$ in production fluid flowing in the production tubing 22 also contacts the interior of the tubing hanger housing 12. Accordingly, the large tubing hanger housing 12 as well as the production tubing 22 must be fabricated of expensive Corrosion Resistant Alloy.

It has been found that cutting the pin threads 5 of the large tubing hanger housing 12 of Corrosion Resistant Alloy material is extremely exacting, subject to error, resulting in a very high expense and risk of failure while fabricating the tubing hanger 12.

IDENTIFICATION OF OBJECTS OF THE INVENTION

A primary object of the invention is to provide an arrangement by which a tubing hanger housing for a well completion system can be coupled to production tubing, yet not be subjected to "wetting" by production fluid, resulting in reduced material and fabrication costs for the tubing hanger housing.

Another object of the invention is to provide a tubing hanger and production tubing assembly for oil and gas completion arrangements, where the tubing hanger housing and the production tubing are made of two distinctly different materials and components which, after assembly, are deployed as one assembly and landed in an oil and gas well.

Another object of the invention is to provide an arrangement such that production tubing and a tubing hanger body can be made of two different materials in order to, (1) save expensive material costs for the large tubing hanger body;

(2) save costs of weld inlays and material incompatibility for the tubing hanger body and the production tubing;

(3) save costs of difficult machining processes by detaching the production tubing from the tubing hanger body during machining prior to assembly;

(4) allow a tubing hanger and production tubing to be deployed as an assembled unit; and (5) allow higher tubing hanger load carrying capabilities.

Another object of the invention is to provide a subsea tubing string suspension system with production tubing of Corrosion Resistant Alloy (CRA) which is threaded into a tubing hanger housing body of non-CRA material with a seal sub of CRA material with metal-to-metal or elastomeric sealing between the top of the production tubing and the bottom of a subsea tree.

Another object of the invention is to provide a production tubing extension sleeve for connection to the tubing hanger body, where the tubing extension sleeve is fabricated of CRA material and the tubing hanger body is fabricated of non-CRA high yield materials, the connection providing isolation of the tubing hanger body from the corrosive production fluid, and the non-CRA material of the tubing hanger body allowing smaller and stronger load bearing surfaces as compared with CRA materials, resulting in high load carrying during testing and subsequent tubing loads.

DESCRIPTION OF THE INVENTION

Figure 1:
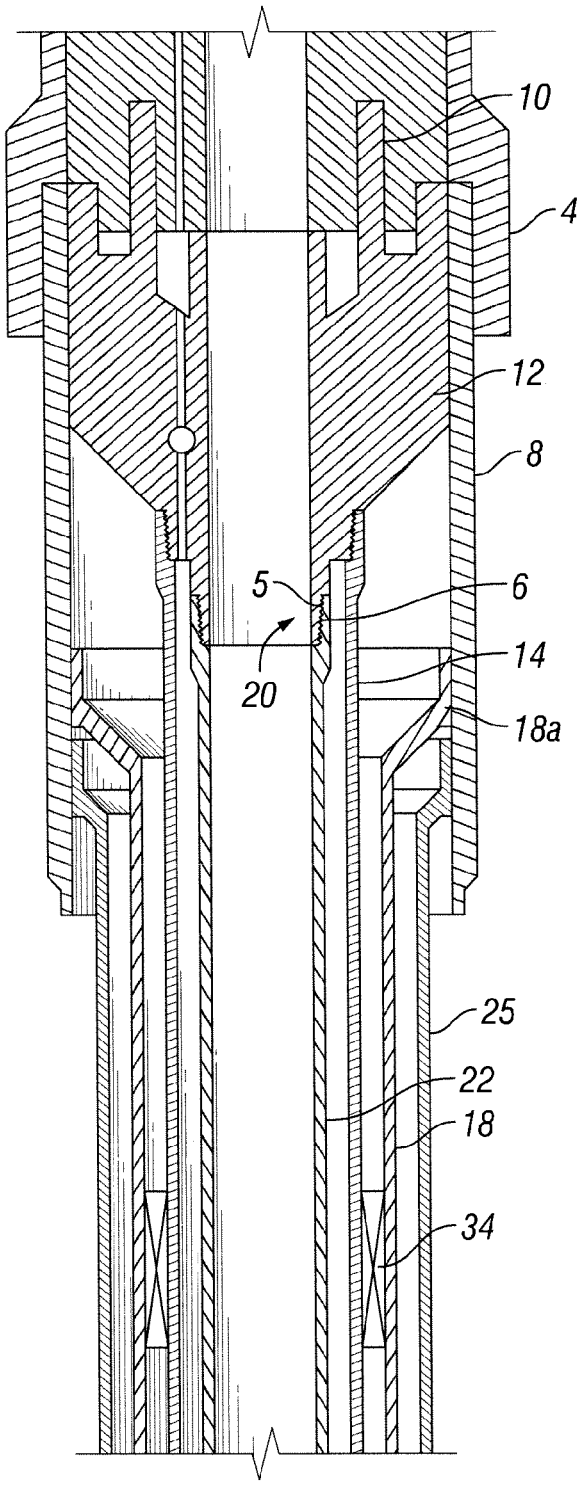
FIG. 1 (Prior Art)
FIG. 1 illustrates a prior art completion assembly with a tubing hanger housing of CRA material with a lower suspension assembly also of CRA material connected to its bottom end and a subsea tree connected to its top end where the tubing hanger housing body is wetted by production fluid flowing from the production tubing.

FIG. 1 as described above illustrates a prior art arrangement of a tubing hanger housing 12 and production tubing 22 run into a wellhead 8 where the tubing hanger body 12 is supported by a tubing hanger lower assembly 12 by a locking and sealing assembly 34 between the tubing hanger lower assembly 14 and the production casing 18. The table which follows lists the reference numbers used to describe the items in the FIG. 1 prior art tubing hanger housing-production tubing connection arrangement.

Reference Numbers for the Prior Art Arrangement of FIG. 1

| Number | Item |
|---|---|
| 4 | Christmas tree connector |
| 5 | pin threads in tubing hanger housing |
| 6 | box threads in production tubing |
| 8 | wellhead |
| 10 | tubing hanger suspension assembly |
| 12 | tubing hanger housing |
| 14 | tubing hanger lower assembly |
| 18 | production casing |
| 18a | production casing hanger |
| 20 | threaded connection |
| 22 | production tubing |
| 25 | casing hanger |
| 34 | locking and sealing mechanism |

Figure 2:
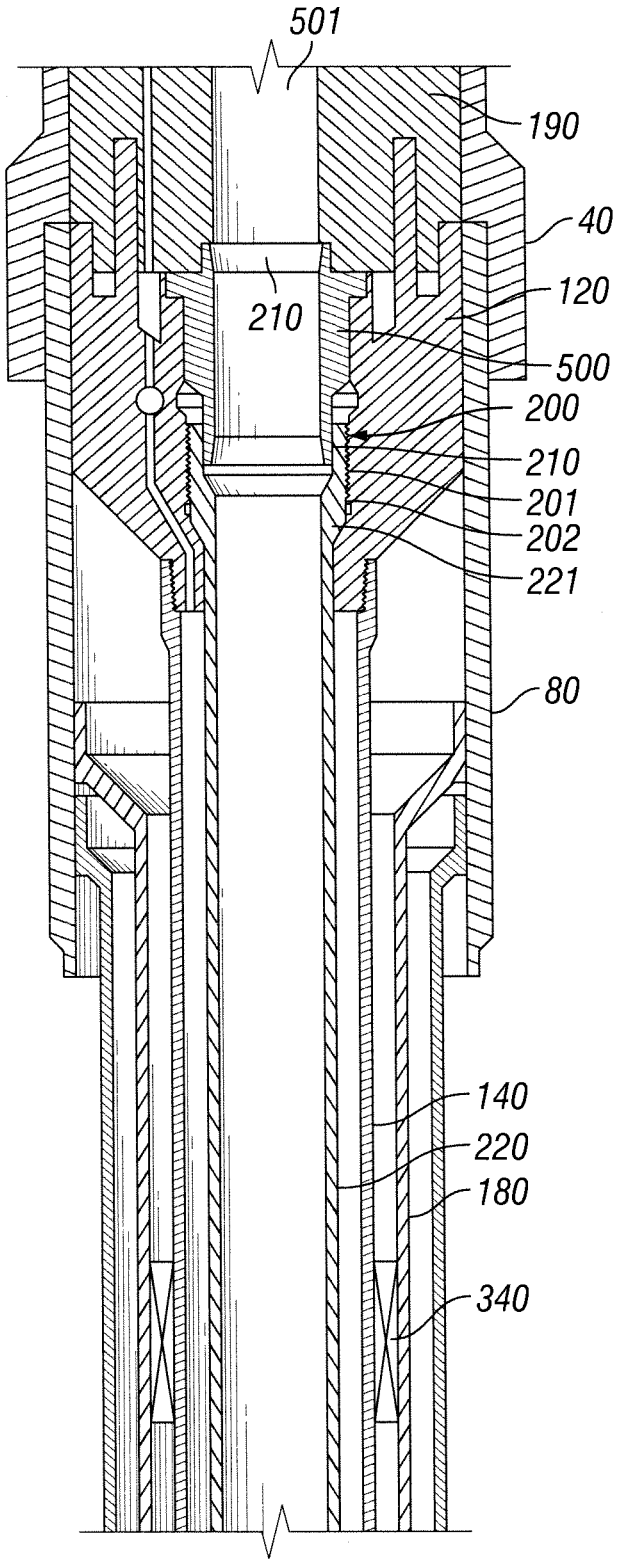
FIG. 2 illustrates an arrangement of the invention with a tubing hanger housing body of non-Corrosion Resistant Alloy material (CRA) secured in the wellhead by a tubing hanger lower assembly with a production tubing extension sleeve for production tubing of CRA material secured by threading to the tubing hanger housing body and a seal sub of CRA material landed and connected to the production extension sleeve.

FIG. 2 illustrates the improved (as compared to the Prior Art arrangement of FIG. 1) having a tubing hanger housing body 120, a production tubing extension sleeve 221, and a tubing production string for an arrangement similar to that of FIG. 1. The tubing hanger body 120 and production tubing 220 are supported via a tubing hanger lower assembly 140 which is locked, sealed and supported by locking and sealing assembly 340 between the tubing hanger lower assembly 140 and production casing 180. The embodiment of FIG. 2 finds special application for expensive subsea wells where the tubing hanger housing 120 can be supported in the wellhead without knowledge of the wellhead dimensions and arrangement. The extension sleeve 221 is connected to tubing hanger body 120 by threads 200. Tubing hanger body 120 is made of an alloy steel, not of a Corrosion Resistant Alloy, an arrangement possible, because the box threads 201 of the tubing hanger body 120 are in threaded connection with pin threads of the production tubing extension sleeve 221. As a result, the tubing hanger housing body 120 is not in contact or "wetted" with the production fluid flowing through the production tubing string 219 and production tubing extension sleeve 221. The production tubing extension sleeve 221 is made of a Corrosion Resistant Alloy (CRA) and pin threads 202 are cut in it so as to couple it with the box threads 201 of the tubing hanger housing body 120 of non-CRA material.

The seal sub 500, also of CRA material, is coupled to tubing extension sleeve 221 by means of a metal to metal or elastomeric seal. A tube 501 of the subsea tree, when coupled to the wellhead and tubing hanger body 120 also includes a metal-to-metal or elastomeric seal 210 for sealing with the seal sub 500.

Reference Numbers for the Invention of FIG. 2

| Number | Item |
|---|---|
| 40 | Christmas tree connection |
| 80 | wellhead |
| 120 | tubing hanger housing |
| 140 | tubing hanger lower assembly |
| 180 | production casing |
| 190 | subsea tree |
| 200 | threaded connection |

-continued

| Number | Item |
|---|---|
| 201 | box threads of tubing hanger body |
| 202 | pin threads of production casing |
| 210 | metal-to-metal and/or elastomeric seal |
| 220 | production tubing |
| 340 | locking and sealing assembly |
| 500 | seal sub |
| 501 | tube in subsea tree |

Figure 3:
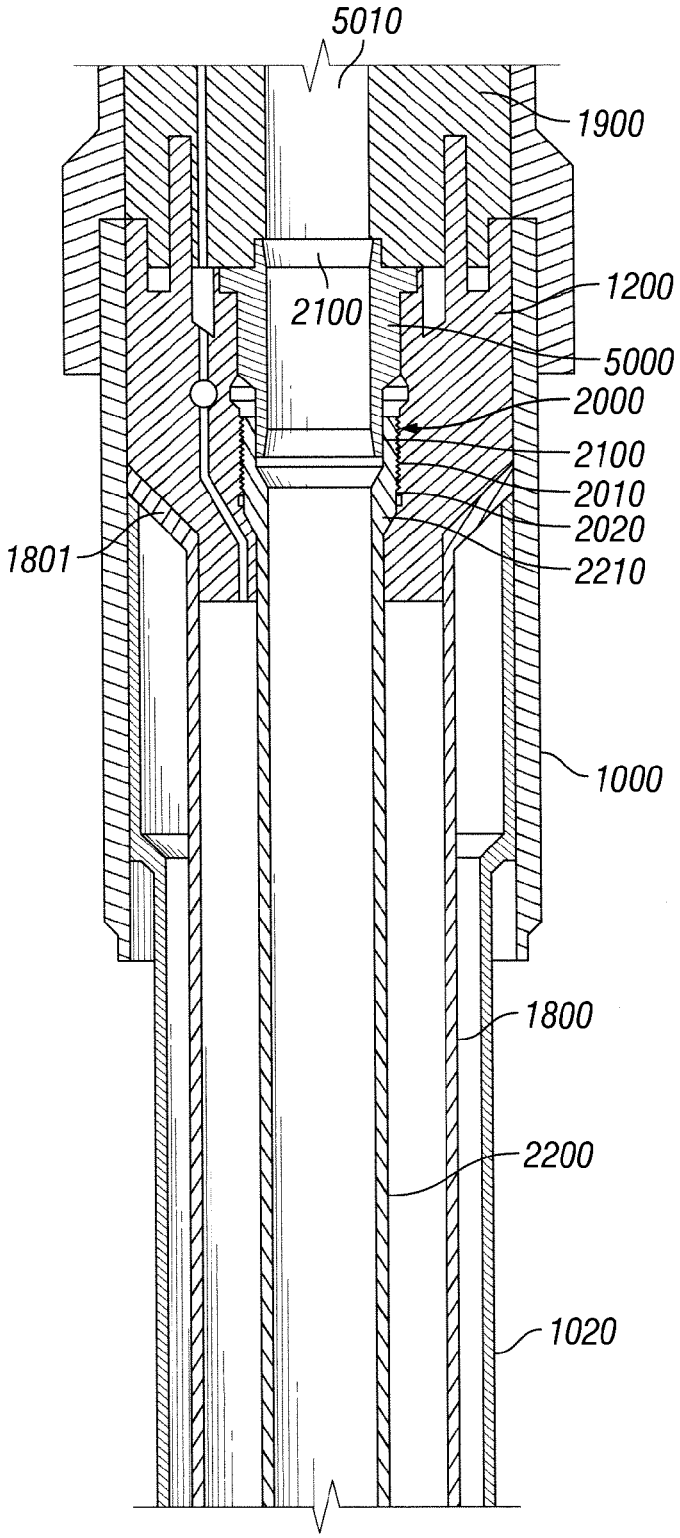
FIG. 3 illustrates a first alternative tubing hanger and production tubing extension sleeve arrangement of the invention where the tubing hanger is landed conventionally on a productive casing hanger shoulder, but with the tubing hanger fabricated of non-Corrosion Resistant Alloy, but with the production tubing fabricated from CRA with a seal sub of CRA material landed on a shoulder of the production tubing extension sleeve in an arrangement which protects the tubing hanger body from contact with the production fluid.

FIG. 3 illustrates an alternative embodiment of the invention where a tubing hanger body 1200 is supported from a shoulder 1801 of production casing hanger 1800, rather than with a locking and seal assembly like that labeled 18 and 180 of FIGS. 1 and 2. The embodiment of FIG. 3 may find application in land based wells or subsea wells. The embodiment of FIG. 3 needs no tubing hanger lower assembly like that labeled 140 and 14 of FIGS. 1 and 2. In all other respects the embodiment is similar to that of FIG. 2 with tubing hanger 1200 made of non-CRA material, but with seal sub 5000 and production tubing 2000 made of CRA material. A listing of reference numbers and items for the embodiment of FIG. 3 follows:

Reference Numbers for the Embodiment of FIG. 3

| Number | Item |
|---|---|
| 1000 | wellhead |
| 1020 | casing hanger |
| 1200 | tubing hanger |
| 1800 | production cashing hanger |
| 1801 | shoulder |
| 1900 | Christmas tree |
| 2000 | threaded connection |
| 2010 | box threads |
| 2020 | pin threads |
| 2100 | metal-to-metal and/or elastomeric seal |
| 2200 | production tubing |
| 5000 | seal sub |
| 5010 | tube in subsea tree |

Figure 4:
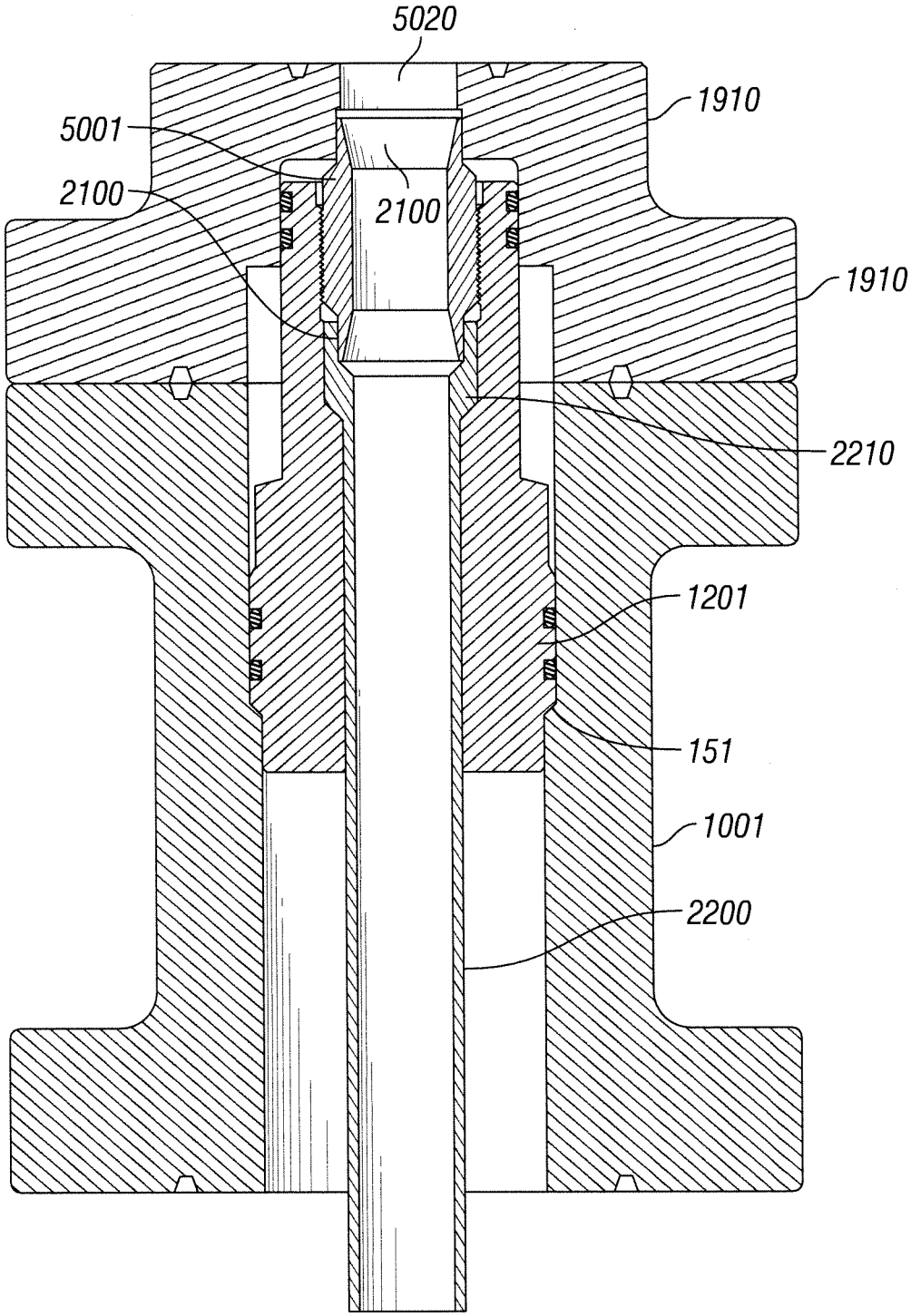
FIG. 4 illustrates a second alternative tubing hanger body of conventional steel alloy material and a production tubing extension sleeve of CRA material landed in a tubing head and with a seal sub landed on the production tubing extension sleeve for protecting the tubing hanger body from corrosive well fluid flowing through the production tubing.

FIG. 4 illustrates another alternative embodiment of the invention where a tubing hanger body 1201 lands on and is supported from landing shoulder 151 of tubing head 1001. Production tubing 2200 is coupled to tubing hanger 1201 preferably in the same way as described in the embodiments of FIGS. 2 and 3. The tubing hanger body 1201 is fabricated of a non-CRA steel alloy while the production tubing extension 2210 is fabricated of CRA material. The coupling of production tubing extension 2210 with tubing hanger 1201 is preferably with pin threads on the production tubing 2202 arranged for screwing into box threads of tubing hanger body 1201, but coupling arrangements other than threaded arrangements may be possible. The seal sub 5001 of CRA material seals with the production tubing extension 2210 in a way like that shown in FIGS. 2 and 3. Metal-to-metal and/or elastomeric seals 2210 seal the Christmas tree tube 5020 of Christmas tree 1910 to the seal sub 5001. The arrangement of FIG. 4 may be used for land wells, and allows cheaper fabrication of the tubing hanger 1201 for wells with highly corrosive hydrocarbons flowing through production tubing 2210 of the well. A listing of reference numbers and items for the embodiment of FIG. 4 follows.

Reference Numbers for the Embodiment of FIG. 4

| Number | Item |
|---|---|
| 151 | landing shoulders |
| 1001 | tubing head |
| 1201 | tubing hanger body |
| 1910 | Christmas tree |
| 2101 | metal-to-metal and/or elastomeric seal |
| 2202 | production tubing |
| 5001 | seal sub |
| 5020 | Christmas tree tube |

Method of Correcting Manufacturing Defects of a Prior Art Tubing Hanger Body

FIG. 1 shows a prior art tubing hanger body 12 which is made of CRA material. Under certain manufacturing machining conditions, the threads 5 could be damaged, a circumstance in the past requiring scrapping of the entire expensive body piece 12. With the inventive concepts described in this specification, the body piece 12 need not be scrapped, but rather the threads 5 of body piece 12, may be over-machined to eliminate thread cutting in the CRA material of body piece 12, thereby creating a machined bore in the body piece 12. A sleeve of CRA material (not illustrated) can be installed to fit within the machined bore of the body piece, with the sleeve having pin threads at its lower end which can be screwed into the box threads 6 of the production tubing 22.

What is claimed is:

1. A suspension arrangement for completing an oil and gas well comprising, a cylindrical tubing hanger housing body (120) made from non-CRA steel, a production tubing (220) having an extension sleeve (221) extending upwardly from an upper portion of said production tubing (220), said production tubing (220) and said extension sleeve (221) made from CRA steel, said extension sleeve (221) being threadedly connected to said tubing hanger housing body (120), and a seal sub (500) of CRA material designed and arranged to be installed within said tubing hanger housing body (120) and to fit within said extension sleeve (221), said seal sub (500) creating a metal to metal seal (210) with said extension sleeve (221) whereby production fluid that flows upwardly through said production tubing (220) and extension sleeve (221) and said seal sub (500) does not touch said tubing hanger housing body (120).

2. The arrangement of claim 1 wherein said extension sleeve (221) has external pin threads (202) formed about a portion of its external surface, and said tubing hanger housing body (120) has internal box threads (201) formed about a lower portion thereof, said pin threads (202) and said box threads (201) being coupled together so that said production tubing (220) is supported from said tubing hanger housing body (120).

3. The arrangement of claim 1 wherein, said seal sub (500) further includes an upper metal to metal seal (210) for sealing with a tube (501) of a subsea tree.

* * * * *